US008225523B2

(12) United States Patent
Moon et al.

(10) Patent No.: US 8,225,523 B2
(45) Date of Patent: Jul. 24, 2012

(54) CLOTHES TREATING APPARATUS AND CONTROLLING METHOD THEREOF

(75) Inventors: Jung Wook Moon, Changwon-si (KR); Dae Yun Park, Changwon-si (KR); Sog Kie Hong, Changwon-si (KR); Jong Seok Kim, Changwon-si (KR); Seung Gyu Ryu, Changwon-si (KR); Hye Yong Park, Changwon-si (KR); Chang Gyu Choi, Changwon-si (KR); Dong Won Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 627 days.

(21) Appl. No.: 12/320,704

(22) Filed: Feb. 2, 2009

(65) Prior Publication Data

US 2009/0260254 A1 Oct. 22, 2009

Related U.S. Application Data

(63) Continuation-in-part of application No. PCT/KR2008/004520, filed on Aug. 4, 2008.

(30) Foreign Application Priority Data

Aug. 3, 2007 (KR) ..... 10-2007-0078289

(51) Int. Cl.
*F26B 19/00* (2006.01)
*F26B 7/00* (2006.01)
*F26B 3/00* (2006.01)

(52) U.S. Cl. ..... 34/90; 34/427; 34/443

(58) Field of Classification Search ..... 34/467, 34/468, 469, 474, 514, 515, 359, 427, 443, 34/90; 122/459
See application file for complete search history.

(56) References Cited

U.S. PATENT DOCUMENTS

| | | | | |
|---|---|---|---|---|
| 5,219,371 | A | 6/1993 | Shim et al. | |
| 5,546,678 | A | 8/1996 | Dhaemers | |
| 5,599,398 | A * | 2/1997 | Lenglen | 134/1 |
| 6,425,192 | B2 | 7/2002 | Arrieta et al. | |
| 6,585,781 | B1 | 7/2003 | Roseen | |
| 6,892,679 | B2 * | 5/2005 | Jameel et al. | 122/379 |
| 7,600,402 | B2 * | 10/2009 | Shin et al. | 68/5 C |
| 2001/0020338 | A1 | 9/2001 | Arrieta et al. | |
| 2010/0043245 | A1 * | 2/2010 | Noviello | 34/60 |

FOREIGN PATENT DOCUMENTS

| | | |
|---|---|---|
| WO | WO 2007/126224 | 11/2007 |
| WO | WO 2008/013382 | 1/2008 |
| WO | WO 2009/008622 | 1/2009 |

* cited by examiner

*Primary Examiner* — Kenneth Rinehart
*Assistant Examiner* — John McCormack
(74) *Attorney, Agent, or Firm* — McKenna Long & Aldridge LLP

(57) ABSTRACT

A clothes-treating apparatus and a controlling method thereof are disclosed. According to a controlling method of a clothes-treating apparatus, a clothes-treating apparatus is capable of steam-cleansing a heat exchanger of a heat pump provided therein automatically. An additional device may not be provided in the clothes treating apparatus to cleanse and sterilize a heat exchanger of a heat pump provided in a mechanism compartment to supply dry or heated air to clothes.

23 Claims, 3 Drawing Sheets

CLOTHES TREATING APPARATUS AND CONTROLLING METHOD THEREOF

This application is a Continuation-In-Part based on International Application PCT/KR2008/004520 filed on Aug. 4, 2008, and claims benefit under 35 U.S.C. §365(c) of the filing date of Korean Patent Application No. 10-2007-0078289, filed on Aug. 3, 2007, both of which are hereby incorporated by reference in their entirety for all purposes as if fully set forth therein.

The present invention relates to a clothes-treating apparatus and a controlling method thereof. More particularly, the present invention relates to a clothes-treating apparatus and a controlling method thereof, which is capable of steam-cleansing a heat exchanger of a heat pump provided therein automatically.

BACKGROUND ART

A clothes-treating apparatus refers to an apparatus which treats clothes placed in an accommodating space provided in a cabinet. Here, the term 'treat' means a predetermined processes, for example, ventilating air to the clothes, supplying steam or hot air to the clothes to remove bad smell, wrinkles and humidity that remain on the clothes. As a result, a user can feel pleasant when putting on the clothes.

Specifically, when putting on a piece of clothing more than once, unpleasant odor, humidity and the like may remain on the clothes and this may give an unpleasant feeling to a user who tries to put on the piece again. To remove the odor, humidity, or the like the clothing might be washed. The repeated washing of the clothes, however, tends to lead to short usage life of the clothes as well as the high cost required to maintain the cleaning of the clothes.

In addition, even after washing and drying the clothes, wrinkles may remain. It is inconvenient for the user to perform additional chores like ironing and variations of it and not to be able to put on the clothing immediately.

To solve these problems, a clothes-treating apparatus may be used to remove unpleasant odor, wrinkles and humidity which remain on clothes. According to the clothes-treating apparatus, moisture is supplied to clothes placed in an accommodating space to remove the unpleasant smell, wrinkles and humidity and air, including dry and hot air, is supplied to the clothes having much moisture because of sprayed steam to dry the clothes.

It may be effective only to expose the clothes to air or hot air when removing the unpleasant smell, wrinkles and humidity. Moisture may also be supplied to the clothes to noticeably enhance the effect of the removal process. If moisture is supplied to the clothes placed in the clothes-treating apparatus, minute water particles are united with unpleasant odor particles remaining on fabric of the clothing. When the water particles unite with the odor elements they separate from the clothes during a drying process, only to be discharged outside. In such the process, the unpleasant odor remaining on the clothes may be removed.

According to the above process, unpleasant smell, wrinkles and humidity remaining on the clothes may be removed and the user may put on the clothes with a pleasant feeling.

The clothes-treating apparatus may include a circulation duct provided under an accommodating space, where clothes to be treated are placed, to circulate and dehumidify or heat air inside the accommodating space. There may be a heat exchanger disposed in the circulation duct, which dehumidifies the air inside the accommodating space by the evaporation and condensation of refrigerant However, the heat exchanger may become polluted by various kinds of contaminants during the process of humidification. Especially if the supplied moisture is in the form of steam. The repeated presence of steam creating an environment having a high temperature and humidity, may result in a hygienic problem as bacteria, mold, or the like may accumulate in the heat exchanger. Further, water condensed from damp air inside the accommodating space may not be clean and might contain unpleasant odor from the clothes or other bad foreign substances. If the water is left out, germs and bacteria might breed resulting in an unpleasant odor.

As a result, it is required to wash and maintain the heat exchanger of the clothes-treating apparatus in a clean condition.

SUMMARY OF THE INVENTION

To solve the aforementioned problems, exemplary embodiments of the present invention provide for a clothes-treating apparatus and a controlling method thereof capable of steam-cleansing a heat exchanger of a heat pump provided therein automatically.

In accordance with one aspect of the present invention, the aforementioned may be achieved by a method of controlling a clothes treating apparatus having a steam generator supplying steam to an accommodating space where clothes are placed, the controlling method includes supplying steam generated by the steam generator to the accommodating space; and steam cleansing a heat exchanger included in the heat pump to dehumidify or heat air inside the accommodating space.

In accordance with another aspect of the present invention, the aforementioned may be achieved by a method of controlling a clothes treating apparatus having an accommodating space where clothes are placed and a steam generator supplying steam to the accommodating space, the controlling method includes steam cleansing a heat exchanger of a heat pump to dehumidify or heat air inside the accommodating space, using steam generated at the steam generator.

In accordance with still another aspect of the present invention, the aforementioned may be achieved by a clothes treating apparatus that includes a cabinet defining an accommodating space where clothes are placed; a heat pump comprising a compressor and a heat exchanger, the heat pump re-supplying air to the accommodating space by dehumidifying or heating air inside the accommodating space; and a steam generator generating steam to supply steam to the accommodating space or the heat exchanger of the heat pump to cleanse the heat exchanger of the pump.

In accordance with yet another aspect of the present invention, the aforementioned may be achieved by a method of controlling a clothes treating apparatus comprising at least one of a heating or dehumidification device contained in a circulation duct and a steam generator adapted to supply steam to an accommodating space containing clothing therein, the controlling method comprising supplying steam generated by the steam generator to the accommodating space to treat the clothing contained therein; and supplying steam generated by the steam generator to the circulation duct to cleanse the heating or dehumidification device.

The present invention has following advantageous effects.

First, an additional device may not be provided in the clothes treating apparatus to cleanse and sterilize a heat exchanger of a heat pump provided in a mechanism compartment to supply dry or heated air to clothes.

Furthermore, the heat exchanger of the heat pump provided in the mechanism compartment to supply hot air to the clothes may be cleansed and sterilized by using steam, generated by a steam generator provided as a moisture supply device in the mechanism compartment, simply and conveniently.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

DETAILED DESCRIPTION OF THE INVENTION

Reference will now be made in detail to the specific embodiments of the present invention, examples of which are illustrated in the accompanying drawings. Wherever possible, the same reference numbers will be used throughout the drawings to refer to the same or like parts.

Figure 1:
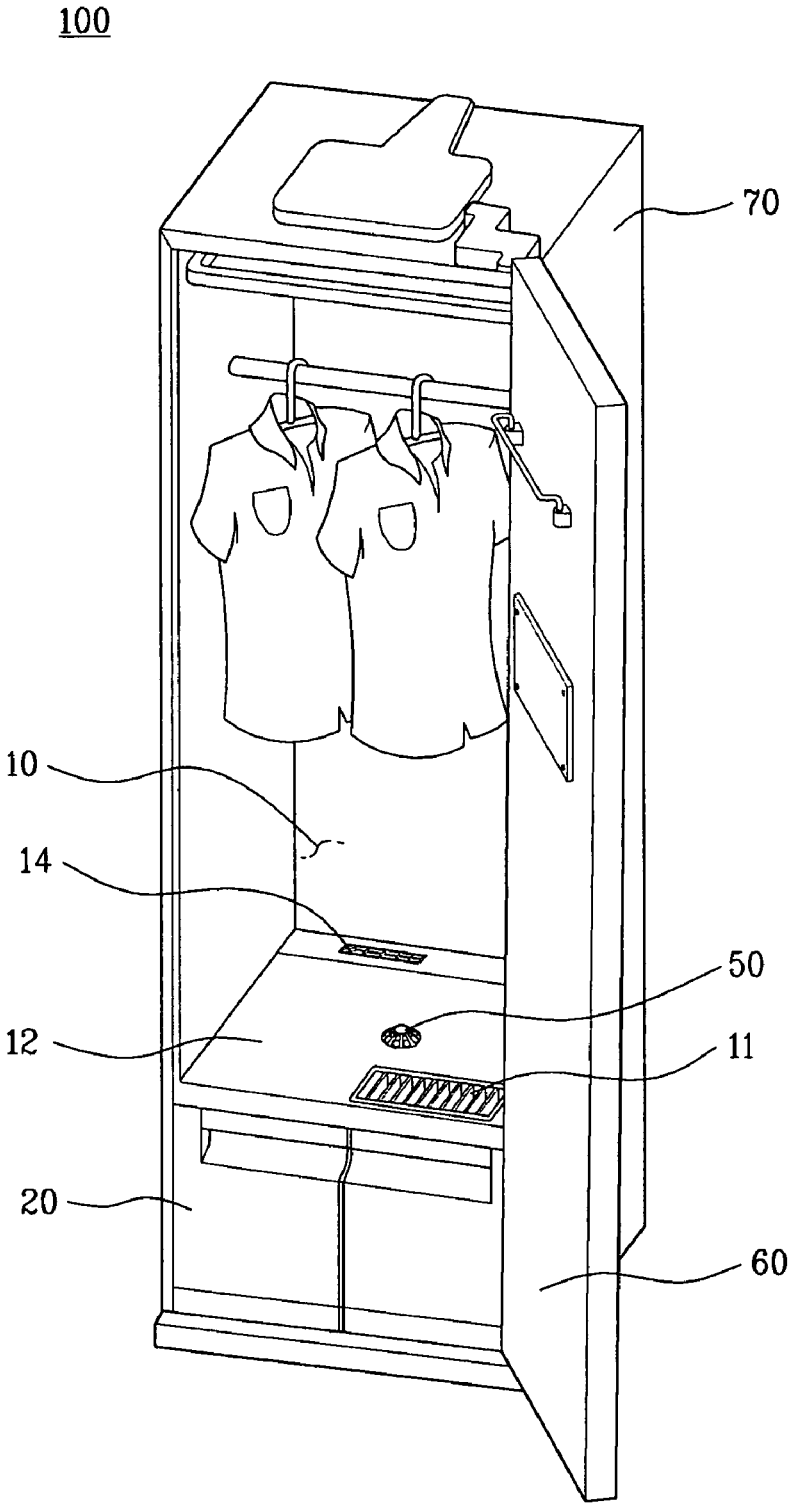
FIG. 1 is a perspective view illustrating a clothes-treating apparatus according to an exemplary embodiment.
Figure 2:
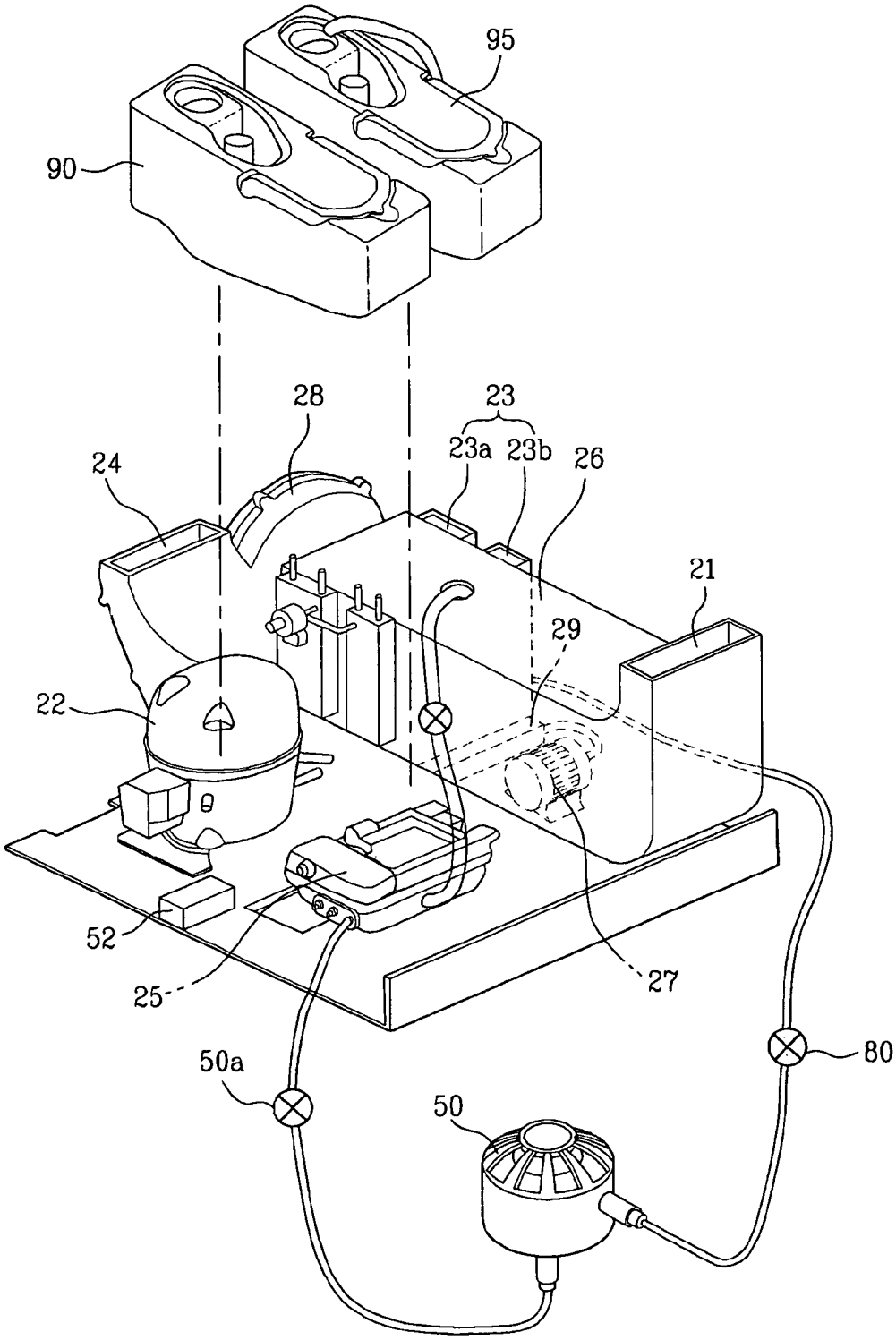
FIG. 2 is a diagram illustrating main components in a mechanism compartment of the clothes-treating apparatus of FIG. 1.

FIG. 1 is a perspective view illustrating a clothes-treating apparatus according to an exemplary embodiment of the invention. FIG. 2 is a diagram illustrating main components in a mechanism compartment of the clothes-treating apparatus of FIG. 1.

As shown in FIG. 1, the clothes-treating apparatus includes an accommodating space 10 which holds clothes therein and a mechanism compartment 20 provided under the accommodating space 10. The mechanism compartment 20 may contain various components to circulate air inside the accommodating space 10 and to dehumidify, heat or circulate the air such that wrinkles, unpleasant odor or humidity remaining on the clothes may be removed.

The accommodating space 10 and the mechanism compartment 20 may be provided in a single cabinet 70 and the accommodating space 10 may be opened and closed by a door 60.

The air of the accommodating space 10 is drawn into the mechanism compartment 20 and the air is re-supplied to the accommodating space 10. An inlet 11 and an outlet 14 are provided at a bottom of the accommodating space 10. The air inside the accommodating space 10 is drawn into the mechanism compartment 20 via the inlet 11 and the air is re-supplied to the accommodating space 10 via the outlet 14.

The reason why the inlet 11 and the outlet 14 are provided at the bottom 12 of the accommodating space 10 is that the mechanism compartment 20 is positioned under the accommodating space 10. However, it is within the scope of the invention to position the inlet 11 and outlet 14 in other locations and fluidly connect them to accommodating space 10 with, for example, tubing or channeling.

In addition, a moisture supply device (25, FIG. 2) may be provided in the mechanism compartment 20 to supply moisture to the clothes within the accommodating space 10. The moisture supply device 25 supplies the moisture to the clothes so that wrinkles and unpleasant smell may be removed during the drying of the clothes. The moisture supplied from the moisture supply device may be steam, sprayed water, a fine particulate dispersion, or the like.

Figure 3:
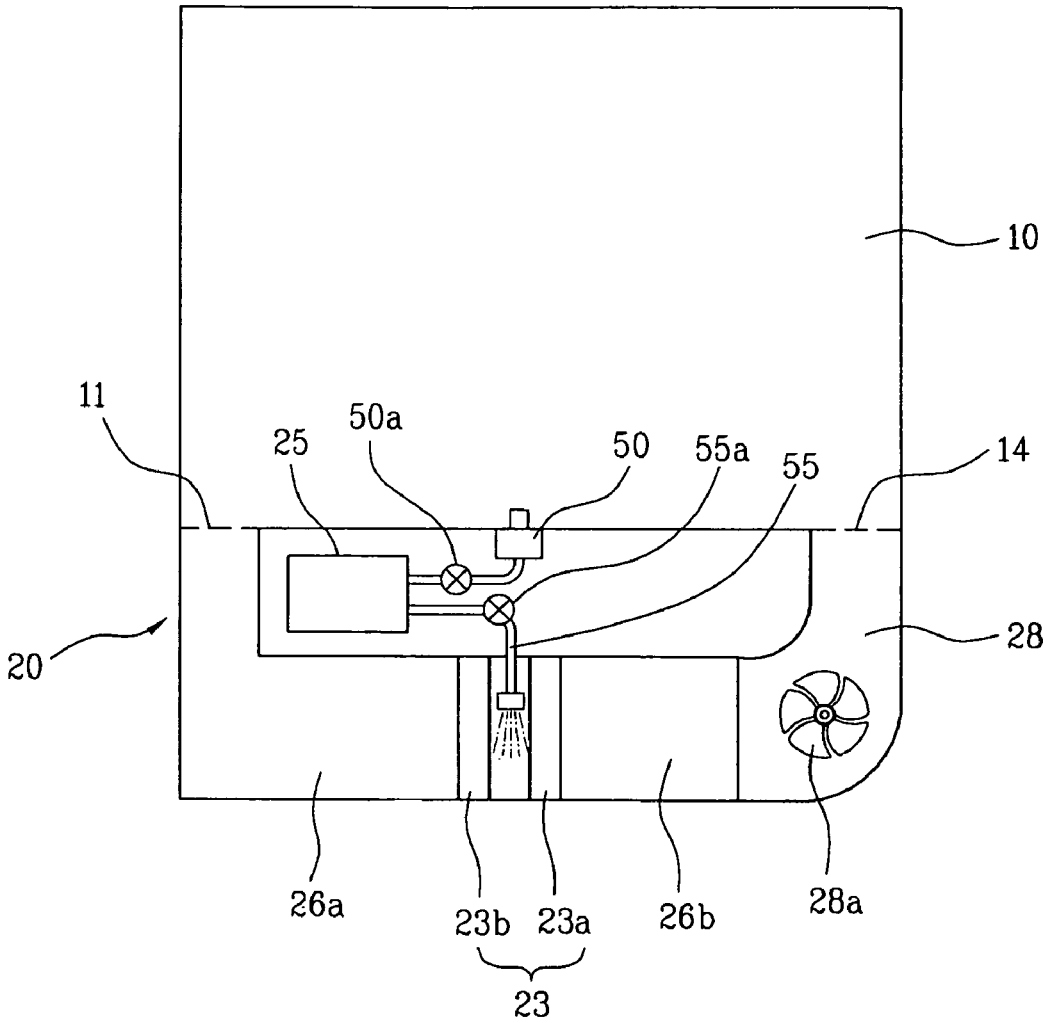
FIG. 3 is a diagram schematically illustrating a washing process of the clothes-treating apparatus of FIG. 1.

In the situation where the moisture is steam, the moisture supply device is configured as a steam generator 25, as exemplified in FIGS. 2 and 3. However, any device capable of supplying moisture to clothes rather than the steam generator 25 may be usable as the moisture supply device. A steam spray device 50 (FIG. 2) may be provided in the accommodating space 10 to spray the steam generated by the steam generator 25.

A structure having a net-like appearance may be installed at the inlet 11 and the outlet 14 to prevent foreign substances having a predetermined size from coming therein.

FIG. 2 is a diagram illustrating the inside of the mechanism compartment 20 of the clothes-treating apparatus.

A steam generator 25 may be provided in the mechanism compartment 20 for generating steam to be supplied to the accommodating space 10 and a circulation duct 26 drawing-in damp air from the accommodating space 10 to dehumidify or heat the air in order to dry and/or heat the clothes.

The steam created by the steam generator 25 may be supplied to the accommodating space 10 via the steam spray device 50, which may be provided in the accommodating space 10. The steam generator 25 may also include a cleansing tube 55 in fluid communication therewith, extending inside of the circulation duct 26 housing the heat exchanger 23.

The circulation duct 26 is in communication with the heat exchanger and will be explained later. Thus, the cleansing tube 55 may extend through the circulation duct 26 to supply the steam to the heat exchanger 23 provided in the circulation duct 26. A cleansing valve 55*a* may be provided to the cleansing tube 55, which extends through the circulation duct 26, to selectively open and close the inflow of the steam inside the cleansing tube 55.

The circulation duct 26 has a ventilation function, circulating un-heated air. The ventilation function is manifested by a ventilation duct 28 housing a fan to ventilate the air that has passed through the circulation duct 26 through outlet 14 (outlet hole 24 may be coupled to outlet 14).

The circulation duct 26 may be identified based on a method of heating dehumidified air. The methods may include a heat pump type system and an electric heater type system. Even if a heat pump or an electric heater is used as a means of heating the air re-supplied to the accommodating space 10, the moisture of the damp air drawn-in via an inlet hole 21 is condensed and dehumidified.

As illustrated in FIG. 2, if a heat pump is used to heat the dehumidified air, an evaporation part 23*b* and a condensation part 23*a* are provided in the circulation duct 26. The refrigerant compressed at the compressor 22 is evaporated in the evaporation part 23*b* to dehumidify the damp air. The refrigerant is condensed and the dehumidified air is heated in the condensation part 23*a*.

Even if the heat pump is used to dehumidify and heat the damp air, an auxiliary electric heater (not shown) may be used to heat the humidified air.

A clothes-treating apparatus having a drying function may be classified, for example, based on a method of drying clothes. The classifications may include a condensation type and an exhaustion type.

The clothes-treating apparatus may be classified as a exhaustion-type or a circulation-type based on whether the damp air drawn out of the accommodating space 10 is dehumidified and re-supplied to the accommodating space or whether the damp air is directly exhausted external to the apparatus. The clothes-treating apparatus according to the exemplary embodiment incorporates the circulation-type process of dehumidifying the air coming from the accommodating space 10 and re-supplying it to the accommodating space. Thus, this specification describes below a circulation-type clothes-treating apparatus.

The air drawn-in via the circulation duct 26 is dehumidified in the evaporation part 23*b* housed in the circulation duct 26 and it is heated in the condensation part 23*a*. The heated air is then re-supplied to the accommodating space via the ventilation duct 28.

An outlet hole 24 is formed at an end of the ventilation duct 28, in communication with the outlet 14 of the accommodating space 10 and an inlet hole 21 is formed at an end of the circulation duct 26, in communication with the inlet 11 of the accommodating space 10.

The heat exchanger 23 may act to dehumidify the damp air having circulated in the accommodating space 10 during an evaporation process of refrigerant supplied from the compressor 22. The heat exchanger 23 then may re-heat the dehumidified air in a condensation process of the refrigerant.

It is necessary to compress the refrigerant between the evaporation and the condensation process of the refrigerant. The compression of refrigerant is performed by the compressor 22 provided in the mechanism compartment 20.

The water condensed at the heat exchanger 23 is temporarily collected in a water collection part 29 positioned under the heat exchanger 23 and the collected water in the water collection part 29 may be drained to a drain part 95 or to an external drain outside the cabinet 70.

The water collection part 29 temporarily may contain not only the water condensed at the heat exchanger 23 in the circulation duct 28, but also any water remaining in the steam generator 25 or any water condensed in the accommodating space 10, yet to be drained to a drain part 95.

A water drain pump 27 may be used to pump the condensed water or polluted water from the water collection part 29. The water drain pump 27 may be mounted in the water collection part 29 and the water collection part 29 may further include a water level sensor (not shown) provided therein. The size of the water collection part 29 may not be substantially large, because the water collection part is configured to temporarily contain the polluted water to be drained to the drain part 95.

The steam generator 25 provided in the mechanism compartment 20 heats the water supplied from a water supply source, which may be a direct tap or a detachable water source 90. The steam generated during the heating of water may be supplied to treat the clothes or to sanitize and clean the heat exchanger 23. Only a relatively small amount of the water may be required to generate steam, therefore, a detachable water source 90 may be used instead of a direct tap. The clothes-treating apparatus thus may be installed in a place without a direct water tap supply. Of course, if water tap supply facilities are positioned nearby, the water source may be a direct water tap.

The water supply source supplies the water to the steam generator 25 and the steam generator 25 distributes the generated steam as desired via the steam spray part 50. Here, a steam supply valve 50*a* may be provided to selectively close the flow of the steam between the steam generator 25 and the steam spray part 50. The steam spray part 50 receives the steam from the steam generator 25 and exhausts the steam into the accommodating space 10 to treat the clothing placed therein.

The air of the accommodating space 10, drawn-in via the inlet hole 21 in fluid communication with the inlet 11 of the accommodating space 10, may be exhausted to the accommodating space 10 via the outlet hole 24 and the outlet 14, after passing through the heat exchanger 23. Ventilation fan 28*a* may facilitate the movement of the air along this circulation path.

According to an exemplary embodiment, a predetermined amount of water contained in a water tank of a predetermined size is heated by a heater mounted in the steam generator 25, in order to generate the steam. However, the present invention is not limited to the above method of steam generation and any device capable of generating steam may be used as a steam generator. For example, a heater may be directly installed around a water supply hose where water passes without containing water in a predetermined space.

If the remaining water of the steam generator is drained to the drain part 95, the remaining water may be drained via the water collection part 29 as mentioned above. The steam generator 25 distributes or sprays the steam into the accommodating space 10 via the steam spray part 50. The steam spray part 50 is connected with the steam generator 25 and any water condensed in the steam spray part 50 during steam distribution may be drained to the drain part 95.

Alternatively, a remaining water valve 80 may be provided between the steam spray part 50 and the water collection part 29. The valve may be opened to allow any water that condensed in the steam spraying part 50 to flow to the water collection part 29. The condensed water is not drained to the drain part 95 spontaneously, but may first be collected or passed through the water collection part 29. The water condensed at the steam spray part 50 may be temporarily contained in the water collection part 29 and drained by the drain pump 27 together with the water condensed at the heat exchanger 23.

The flow of the condensed water to the drain part 95 from the water collection part 29 is performed by the water drain pump 27 which is provided along a flow path between the drain part 95 and the water collection part 29. If the drain part 95 is positioned higher than the water collection part 29, the water drain pump 27 compensates for the height increase in the flow path.

As illustrated in FIG. 2, the heat exchanger 23 includes an evaporation part 23*b* where heat is drawn from the damp air passing through the heat exchanger 23 as the refrigerant is evaporated. The damp air, which is supplied from the accommodating space 10, is also dehumidified as it passes through the evaporation part 23*b*. More specifically, the moisture in the damp air is condensed as the damp air cools, and is collected in the evaporation part 23*b*. The moisture and resulting condensed water may be dirty or contain bacteria and as a result may pollute the evaporation part 23*b* of the heat exchanger 23 during the dehumidification process.

To prevent the pollution of the heat exchanger 23, it is necessary to cleanse the heat exchanger 23 periodically, but it may be difficult for a common user to gain access to the heat exchanger 23, which is mounted in the mechanism compartment.

A controlling method of the clothes-treating apparatus presents a method of simply cleansing and sterilizing the heat exchanger 23 without installation of additional facilities. The controlling method of the clothes-treating apparatus, according to an exemplary embodiment may include: generating steam and supplying the steam to the accommodating space to steam treat clothing and also supplying the steam to the heat exchanger of the heat pump to steam cleanse the heat exchanger. The heat pump is, of course, provided to dehumidify and heat the air circulating from the accommodating space.

In one embodiment, the steam cleansing of the heat exchanger is performed just after the steam treating of clothing. It will be understood that the time interval between steam treating the clothing and steam cleaning the heat exchanger will be very small in order to obviate the need to operate the steam generator (i.e., heat the water in the steam generator) more than one time, that is, one time for the steam treating of clothing and one time for cleansing the heat exchanger. Thus, after the steam generator supplies steam to the accommodating space 10, the steam remaining in the steam generator may be used for cleaning the heat exchanger. It is also within the scope of the invention to supply steam simultaneously to the accommodating space 10 for steam treating and to the heat exchanger 23 for steam cleansing.

As illustrated in FIG. 2, the steam generator 25 has the cleansing tube 55 installed therein and is mounted in the mechanism compartment 20. The heat exchanger 23 may include evaporation part 23*b* the condensation part 23*a*. During the steam cleansing process, the steam may supplied to the evaporation part 23*b* and/or the condensation part 23*a* via the cleansing tube 55, which is in fluid communication with the steam generator 25.

The supplying of the steam to the heat pump for cleansing purposes, may mean that the steam is supplied to the heat exchanger 23 included in the heat pump. The steam generator 25 is preferably a device capable of generating and supplying steam to the clothing placed in the accommodating space. However, the steam generated by the steam generator 25 is a high temperature water vapor and thus has strong sterilizing capabilities. Therefore, the steam generated by the steam generator 25 to treat the clothing may also be used to cleanse and sterilize the heat exchanger 23 without need for any auxiliary devices.

As illustrated in FIG. 2, the cleansing tube 55 may fluidly connect the steam generator 25 to the heat exchanger 23. The steam generator 25 may at the same time be fluidly connected with a steam tube to supply steam to the accommodating space 10 where the clothes are placed.

If the steam cleansing of the heat exchanger 23 is performed after the steam treating of clothing in the accommodating space 10, the steam generator 25 has already been heated up to a predetermined temperature to generate steam. Therefore, since the steam generator 25 is already heated it may be quicker and more efficient to generate steam for steam cleansing soon after steam treating process. Similarly, it may be equally efficient to conduct the steam treating and steam cleansing simultaneously, thus decreasing cycle time and efficiently utilizing the available generated steam. Additionally, the heat exchanger 23 is preferably cleansed and sterilized prior to supplying hot air to the heat exchanger 23.

The cleansing tube 55 installed in the steam generator 25, opened toward the heat exchanger 23, makes it possible to supply the steam generated by the steam generator 25 to the heat exchanger 23. The cleansing valve 55*a* provided at the cleansing tube 55 is opened or closed to control the supply the steam to the heat exchanger 23. The opening of the valve may be accomplished by use of an electromagnetic valve (not shown) controlled by a controller 52 of the clothes-treating apparatus. It is noted that the cleansing tube may also branch off the steam supply tube which supplies steam from the steam generator to the accommodating space.

It is preferable that the cleansing valve 55*a* and the steam supply valve 50*a* are opened separately, that is, not simultaneously. If the steam supply valve 50*a* is opened and steam is supplied to the clothes placed in the accommodating space 10, it is may be unnecessary to open the both the cleansing valve 55*a* and the steam supply valve 50*a* at the same time. As a result, in one embodiment, the controller prevents both valves from being opened simultaneously.

It is also envisioned, however, that both the cleansing valve 55*a* and steam supply valve 50*a* may be opened simultaneously for a predetermined amount of time. For example, at or towards the end of the steam treating process, when steam supply valve 50*a* is opened, thereby allowing steam to flow into the accommodating space, cleansing valve 55*a* may be opened at the same time allowing steam to enter and cleanse the heat exchanger 23.

The controlling method of the clothes-treating apparatus may further include the process of supplying dehumidified or heated air by circulating the air inside the accommodating space 10 and through the heat exchanger 23, after the steam cleansing. The air supply process may further include drying the clothes by removing moisture, such as steam, from inside the accommodating space. During the air supply process, the heat pump is operated so that the damp air may be heat-exchanged by the heat exchanger 23.

As mentioned above, it is possible for the controller 52 of the clothes-treating apparatus to control the steam cleansing, such that the cleansing is performed automatically. The heat exchanger 23 may be polluted during the circulation of the air inside the accommodating space 10. One measure of the degree of pollution may be the number of cycles of air supplying. After a certain number of cycles, the controller 52 may commence the steam cleansing operation. For example, if the air supplying is performed 10 times, it is preset to start the steam cleansing automatically. In such an embodiment, the number of air cycles between steam cleansing operations may be predetermined.

The steam cleansing of the heat exchanger 23 may be performed after or during the steam treating of clothing in the accommodating space 10. Alternatively, if a cleansing signal is input by a user, without performance of the steam treating of clothing, the controller 52 may cause the steam cleansing of the heat exchanger 23 to be performed separately. Thus if the steam treating is not performed before steam cleansing, the steam generator 25 generates steam to perform only the steam cleansing of the heat exchanger 23.

As the operation of steam cleansing only may be identical to the steam cleansing explained earlier, its detailed explanation will be omitted. As stated above, in one embodiment the separate steam cleansing of the heat exchanger may be initiated, for example, by the cleansing signal input by the user. In another embodiment it may be initiated depending on the number of times an air supplying cycle is run, or depending on a preset time period.

The air supplying process conducted via the heat pump may be performed sequentially after the steam cleansing/steam treating, or after the separate steam cleansing. In the steam cleansing process according to the controlling method of the clothes-treating apparatus, the cleansing tube 55 may spray steam downward into the heat exchanger 23 from an upper portion thereof. The steam sprayed via the cleansing tube 55 may cleanse and sterilize the heat exchanger 23.

The controlling method according to this embodiment may further include collecting water condensed from the steam supplied to the heat exchanger 23. The steam generated at the steam generator 25 may tend to condense after passing the cleansing tube 55 and cleansing the inside of the heat exchanger 23. As a result, the water condensed after cleansing the heat exchanger may be collected in the water collection part 29 and be drained to a drain part 95 by the operation of the water drain pump 27.

FIG. 3 is a diagram simply illustrating the cleansing process of the heat exchanger 23. As shown in FIG. 3, the steam generated at the steam generator 25 passes a housing of the circulation duct 26 and it is sprayed via the cleansing tube 55 extending toward the heat exchanger 23. Through the above process, the heat exchanger 23 may be cleansed and sterilized.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The present invention has industrial applicability. First, an additional device may not be provided in the clothes treating apparatus to cleanse and sterilize a heat exchanger of a heat pump provided in a mechanism compartment to supply dry or heated air to clothes. Furthermore, the heat exchanger of the heat pump provided in the mechanism compartment to supply hot air to the clothes may be cleansed and sterilized by using steam, generated by a steam generator provided as a moisture supply device in the mechanism compartment, simply and conveniently.

What is claimed is:

1. A controlling method of a clothes treating apparatus comprising a heat pump and a steam generator adapted to supply steam to an accommodating space of the clothes treating apparatus, wherein the heat pump has a heat exchanger comprising an evaporation part and a condensation part, the controlling method comprising:

supplying steam generated by the steam generator to the accommodating space; and supplying steam generated by the steam generator to a heat exchanger of the heat pump to cleanse the heat exchanger of the heat pump, wherein steam is supplied between the evaporation part and the condensation part during supplying steam to the heat exchanger of the heat pump.

2. The controlling method of claim 1, wherein steam is supplied to the accommodating space and the heat exchanger of the heat pump simultaneously.

3. The controlling method of claim 1, wherein steam is supplied to the accommodating space and the heat exchanger of the heat pump substantially simultaneously.

4. The controlling method of claim 1, wherein the steam is supplied to the heat pump via a cleansing tube extended toward the heat exchanger from the steam generator.

5. The controlling method of claim 4, wherein a cleansing valve is provided at the cleansing tube to selectively close the supply of the steam generated from the steam generator to the cleansing tube.

6. The controlling method of claim 4, further comprising:

supplying air to the accommodating space by circulating the air inside the accommodating space via the heat pump, after supplying steam to the heat exchanger of the heat pump.

7. The controlling method of claim 6, wherein the heat pump is operated during in the step of supplying air.

8. The controlling method of claim 6, wherein the steam is supplied automatically to the heat exchanger of the heat pump if the step of supplying air is performed more than a predetermined number of times.

9. The controlling method of claim 6, wherein the steam is supplied automatically to the heat exchanger of the heat pump after a predetermined period of time passes.

10. A controlling method of a clothes treating apparatus comprising an accommodating space where clothes are placed and a steam generator supplying steam to the accommodating space, the controlling method comprising:

steam cleansing a heat exchanger of a heat pump using steam generated by the steam generator, wherein the heat pump is adapted to dehumidify and heat the air in the accommodating space, wherein the heat exchanger has an evaporation part and a condensation part, and wherein steam is supplied between the evaporation part and the condensation part during steam cleansing a heat exchanger.

11. The controlling method of claim 10, wherein during the steam cleansing of the heat exchanger, the steam is supplied to the heat exchanger via a cleansing tube in fluid communication with the heat exchanger and the steam generator.

12. The controlling method of claim 11, wherein a cleansing valve is provided at the cleansing tube to selectively close the supply of the steam generated by the steam generator.

13. The controlling method of claim 10, wherein the steam cleansing of the heat exchanger is performed according to a cleansing signal that is selectively inputted.

14. The controlling method of claim 10, wherein the steam cleansing of the heat exchanger is performed periodically.

15. The controlling method of claim 10, further comprising:

supplying air by circulating the air inside the accommodating space and through the heat exchanger, after the steam cleansing of the heat exchanger.

16. The controlling method of claim 15, wherein the heat pump is operated in the step of supplying air.

17. A clothes treating apparatus comprising:

a cabinet having an accommodating space where clothes are placed;

a heat pump comprising a compressor and a heat exchanger, the heat pump re-supplying air to the accommodating space by dehumidifying or heating air inside the accommodating space; and a steam generator adapted to generate and supply steam to the accommodating space and the steam generator further adapted to generate and supply steam to the heat exchanger of the heat pump, wherein the heat exchanger of the heat pump comprises an evaporation part adapted to evaporate refrigerant through a heat transfer process and a condensation part condensing the refrigerant through a heat radiation process, and wherein steam is supplied between the evaporation part and the condensation part during supplying steam to the heat exchanger.

18. The clothes treating apparatus of claim 17 wherein the steam generator is adapted to supply steam to the accommodating space and the heat pump simultaneously.

19. The clothes treating apparatus of claim 17, wherein the steam generator supplies the steam via a cleansing tube in fluid communication with at least one of the evaporation part and the condensation part.

20. The clothes treating apparatus of claim 19, wherein a cleansing valve is provided at the cleansing tube to selectively close the supply of the steam generated by the steam generator.

21. The clothes treating apparatus of claim 20, further comprising:

a steam spray part installed at the accommodating space to spray the steam supplied from the steam generator; and a steam supply valve provided at a steam supply tube, which fluidly connects the steam generator and the steam spray part, to control the flow of the steam, wherein the steam supply valve and the cleansing valve are opened separately.

22. The clothes treating apparatus of claim 20, further comprising:

a steam spray part installed at the accommodating space to spray the steam supplied from the steam generator; and a steam supply valve provided at a steam supply tube, which fluidly connects the steam generator and the steam spray part, to control the flow of the steam, wherein the steam supply valve and the cleansing valve are opened simultaneously.

23. The clothes treating apparatus of claim 19, wherein the heat exchanger is mounted in a circulation duct adapted to circulate and re-supply air from the accommodating space, and wherein the cleansing tube passes through the circulation duct and is in fluid communication with at least one of the evaporation part and the condensation part.

* * * * *